US005799453A

United States Patent [19]

Westerlund

[11] Patent Number: 5,799,453

[45] Date of Patent: Sep. 1, 1998

[54] STRUCTURE AND METHOD OF FABRICATION

[76] Inventor: Robert E. Westerlund, 125 Elizabeths Ct., Antioch, Tenn. 37013-1762

[21] Appl. No.: 678,914

[22] Filed: Jul. 12, 1996

[51] Int. Cl.[6] ..... E04B 1/00

[52] U.S. Cl. ..... 52/259; 52/250; 52/309.12

[58] Field of Search ..... 52/344, 741.41, 52/600, 309.12, 601, 602, 309.16, 309.17, 562, 563, 564, 250, 259, 90.1; 249/40, 213, 215, 216, 218, 309.8

[56] References Cited

U.S. PATENT DOCUMENTS

| | | | |
|---|---|---|---|
| 1,293,377 | 2/1919 | Donaldson . | |
| 1,462,934 | 7/1923 | Fluor . | |
| 1,671,462 | 5/1928 | Bemis | 52/250 X |
| 1,821,355 | 9/1931 | Murray | 52/602 X |
| 3,363,371 | 1/1968 | Villalobos . | |
| 3,555,830 | 1/1971 | York . | |
| 3,659,388 | 5/1972 | Sirianni | 52/250 X |
| 4,193,240 | 3/1980 | Odoerfer . | |
| 4,472,919 | 9/1984 | Nourse . | |
| 4,909,001 | 3/1990 | Gonzales Espinosa | 52/259 X |
| 5,248,549 | 9/1993 | Silva et al. | 52/601 X |

*Primary Examiner*—Creighton Smith
*Attorney, Agent, or Firm*—Andrus, Sceales, Starke & Sawall

[57] ABSTRACT

A building structure has an outer shell including sidewalls and an integrated roof projecting upwardly therefrom. The sidewall and roof include an inner plurality of supporting studs with a mesh member secured abutting the inner side of the studs. A plastic outer wall is formed from a plurality of polystyrene panels. The panels are located in abutting relation and interconnected to each other and to the studs to define a plastic wall and defining a concrete receiving space. T-bars are located between abutting panels and abut the exterior of the panels. A tie-rod connects the T-bars to the studs to support the insulating wall in spaced relation to the mesh. The panels are recessed to form columns within the wall and roof structure. Reinforcing bars are located within the columns. Wet concrete is deposited into the concrete space and thereby integrally interconnected to the inner wall unit and to the outer insulating wall to form a continuous integral wall and roof. Door and window openings are incorporated directly into the structure prior to pouring of the wet concrete and are provided with appropriate strengthening beams as required.

27 Claims, 13 Drawing Sheets

STRUCTURE AND METHOD OF FABRICATION

BACKGROUND OF THE INVENTION

This invention relates to a method and structure for buildings having an outer insulated reinforced concrete wall and roof, particularly residential homes as well as other similar relatively small building.

Residential homes and similar smaller buildings are generally formed of a wood or similar frame construction with wood, brick and similar exterior walls. Prefabricated residential buildings may be factory formed using wood studding and similar exterior and interior walls secured to the wood studs. Although a coated steel residential structure has been offered, such building had a limited exposure and only a limited number of such buildings were sold.

With the recognition of limited energy resources, energy efficiency of buildings including residential structure is now recognized as having substantial significance. Residential buildings using the conventional construction method, increase the energy efficiency by increasing the thickness of the studding walls and introducing of a suitable insulation such as fiberglass batts and the like into the increased wall thickness. In addition, of course, homes are more tightly sealed through the various improved window and door structures which generally include high thermal insulating glass and the like.

Large building structures have used a support frame-work of substantial steel beams with precast concrete paneling applied. Notwithstanding, many of the advantages associated with concrete structure, such structures of concrete have not been generally applied in the construction of residential buildings such as homes, small apartment buildings and the like. Residential buildings and various apartment buildings have, of course, been built with a conventional wood frame work and the outer wall covered with an outer stucco shell or surface. In such instances, however, the stucco is a relatively thin decorative facade covering and does not form a structural part of the building construction.

Construction with reinforced concrete support walls has been used in many commercial buildings and high rise office and apartment buildings as well as other various constructions such as tunnels, bridges and the like because of the structural strength created with a reinforced concrete construction. The concrete wall structures have not been used in residential buildings primarily because of cost, and lack of building procedures and available systems.

In conventional poured concrete wall constructions, special forms are used which are dismantled after appropriate erection of the wall structure. This method involves relatively costly forms as well as the cost of erection and subsequent dismantling. In addition, after each use, the forms must be cleaned, stored and transported to the next building site. Overall, concrete wall construction has been relatively expensive and has been a significant factor in minimizing the use in the residential home markets other than in forming of basement wall structures.

SUMMARY OF THE PRESENT INVENTION

The present invention is particularly directed to building structures having a poured reinforced concrete envelope structure and particularly to such a structure for residential and relatively other small buildings including small apartment buildings such as a duplex, four family and the like. Generally, in accordance with the teaching of the present invention, an outer form unit for containing the wet concrete includes an outer thermal insulation board having a high R-factor connected, in spaced relation, to an inner expanded metal or other suitable support secured to spaced studding or the like. Thus, the inner support may be constructed to form a part of an interior wall of the structure. The building shell or envelope is formed by introducing wet concrete into the form unit and allowing the concrete to hardened. The insulation board remains secured to concrete wall and forms an integrated part of the structure. The insulation provides a high degree of thermal blockage on the exterior of the structure and thus provide maximum insulating effectiveness while permitting using metal or other studs, and an inner support member of a standard well known construction. In a preferred construction, the inner frame work is provided for the envelope including both the walls and the roof structures, with a backing for the inner wall such as expanded metal or other suitable member. An inner temporary support structure positions the inner wall and roof structures to produce plumbed walls. An outer temporary support structure may also be used to support the outer thermal insulation boards. In corners, columns and openings, a reinforcing unit is provided in accordance with good engineering practice. A total area or system is then encased in concrete to provide a continuous reinforced concrete mass in the wall and roof area. This not only provides a high strength building but provides a total concrete mass acting as a highly significant and effective heat sink which will level off temperature variation during the day time and night time, thereby minimizing the energy consumption required to maintain the building in a comfortable state. The reinforced concrete also defines a structural frame in the building, and any specified fire rating can be readily provided by use of the necessary thickness in the walls and ceilings. The location of the insulation board to the exterior side of the building is also advantageous in that various insulating materials create toxic emission, particularly when subject to significant heat. The essentially solid concrete wall structure of the present invention will effectively eliminate the disadvantages associated with the use of such insulating materials, which are otherwise desirable because of their high thermal insulating factor.

More particularly in a preferred and unique construction of the present invention, an inner frame work formed of metal studs and roof members is provided and interconnected to a suitable foundation. The metal framework is specially constructed to provide a self-supporting framework. The interconnection between the walls and the roof as well as in the central interconnections of the roof studs, such as a roof peak and the like, are specially formed with recessed portions on the exterior side. The metal studs are then covered with an appropriate expanded metal. The recessed portions of the roof line and the connection between the roof and sidewalls each define a concrete beam location, with reinforcing members of steel or other suitable material, which are to be buried within the concrete to reinforce the connections therebetween. The reinforcing members are generally known as rebars and are hereinafter so defined. The outer insulating walls are then secured to the structure in suitably spaced relation by suitable spacing ties, preferably in accordance with the stud spacing. At appropriate locations, the outer walls are specially constructed to define concrete columns within which suitable rebars are also located. At those locations, the rebars also preferably project upwardly into the roof structure to provide more effective reinforcement of the concrete sidewall system and the roof structure.

The inner metal studs are located on appropriate centers, and with the expanded metal define an inner hidden wall structure or panel. The various plumbing and electrical lines and connections are located within the panel. The interior wall of the structure is defined by an appropriate wall covering, secured to the metal studs to finish the interior of the building. The panel may be formed with a suitable inner finished wall.

In accordance with the present invention, the wall studs and necessary interconnections between the studs, the expanded metal, the outer insulating panels of the insulation are preferably preformed in a factory and then assembled on site, but may be totally fabricated and assembled on site. The structure is directly adapted to the use of conventional electrical and plumbing systems, doors, windows and like devices.

The system is further readily adapted to a modular form of a panel construction for both the sidewalls and roof of a building with relatively readily understood erection procedures. The modular panel utilizes reliable interconnections of components for erection of the structures as a relatively low cost, high strength and energy efficient buildings. Thus, the on-site labor time, particularly to enclose the building structure, is minimized thereby adapting the construction in varying weather conditions.

The composite construction of this invention for buildings provides a high "R" insulating factor and significantly minimizes the energy requirements for heating and cooling of buildings. Thus, an "R" value exceeding the present super insulated house or more can be readily provided. For example, each inch of expanded polystyrene (EPS) typically has an insulation rating of 4R. Typically, the outer wall may use a 6 inch styrofoam. In addition, the concrete construction is rotproof, fireproof, termite proof, and the like and contributes to a structure having a lifetime greatly in excess of more conventional home constructions.

After the construction of the exterior wall unit of the building, any suitable exterior material can be applied if considered desirable or necessary to cover the outer insulating wall. Thus, the exterior wall can be covered with conventional siding and roofing materials including brick, stone, wood, steel or vinyl members. In addition, various other sprayed on or otherwise applied products such as cement and stucco can also be used to finish the exterior.

The system of this invention is also particularly applicable in geographical areas subject to special climatic conditions. Thus, various areas, such as California, have a continuing problem with fire hazards. Coastal areas having severe humidity and moisture problems may rapidly adversely effect the condition of the homes. Many areas have wind, flood and earthquake conditions, which require special consideration in residential buildings. Severe cold or hot temperatures also require special considerations with respect to residential building constructions.

The present invention thus provides a highly significant improvement in residential type building applications and one which can be economically implemented.

The increased insulating and temperature control characteristic, the increased strength such as to withstand wind loads of a hurricane level and fire resistance as well as overall security characteristic and the anticipated system assures an overall highly cost effective and energy efficient building structure.

BRIEF DESCRIPTION OF THE DRAWINGS

The drawings furnished herewith illustrate the best mode of the present invention in which the above advantages and features are clearly disclosed as well as others which will be readily understood from the following description of the illustrated embodiment.

In the drawings.

Figure 1:
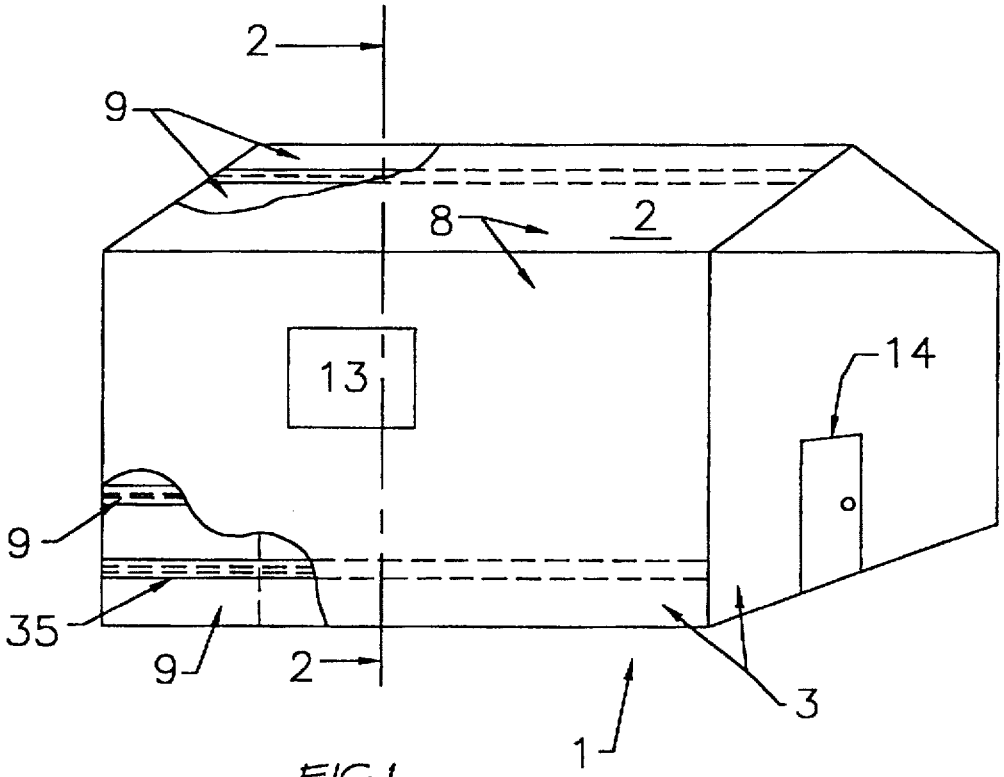
FIG. 1 is a side elevational view of a building illustrating an embodiment of the invention.
Figure 8:
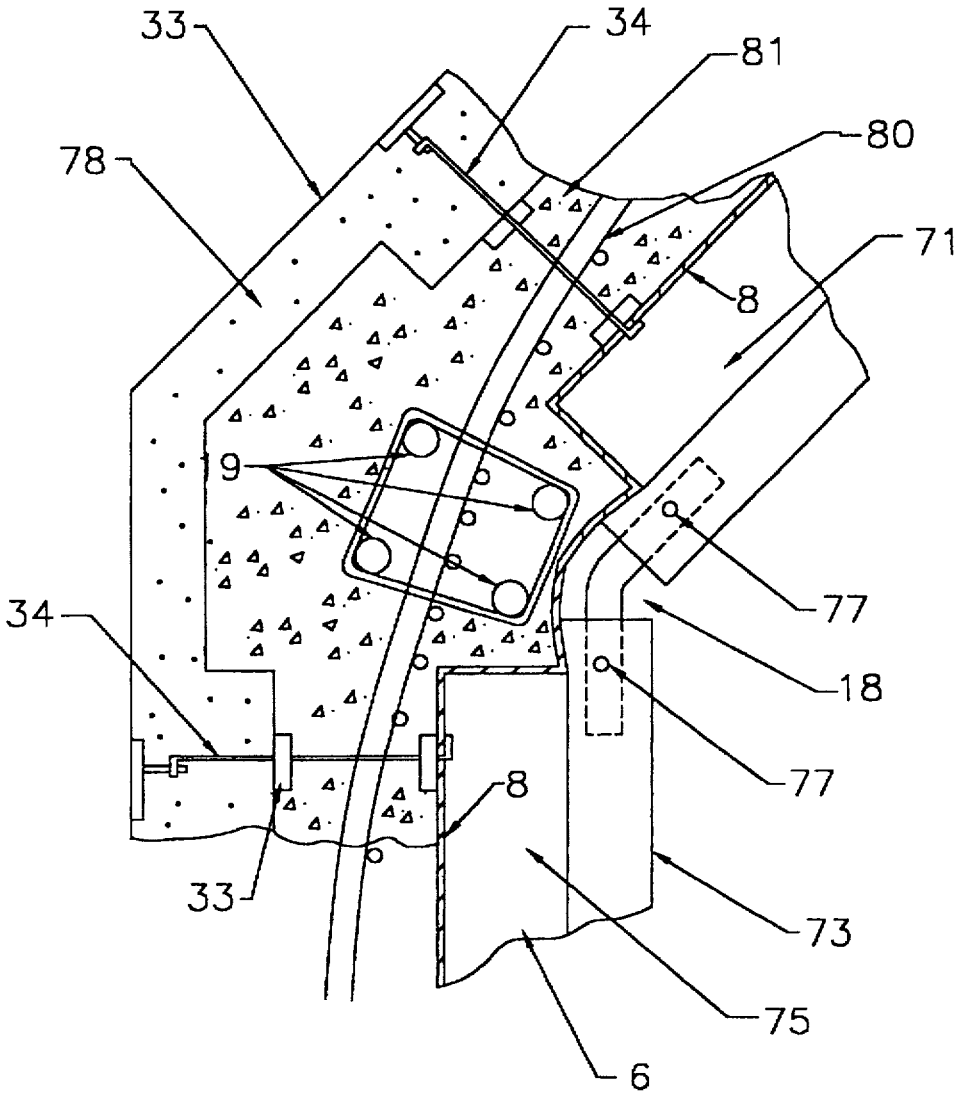
Figure 9:
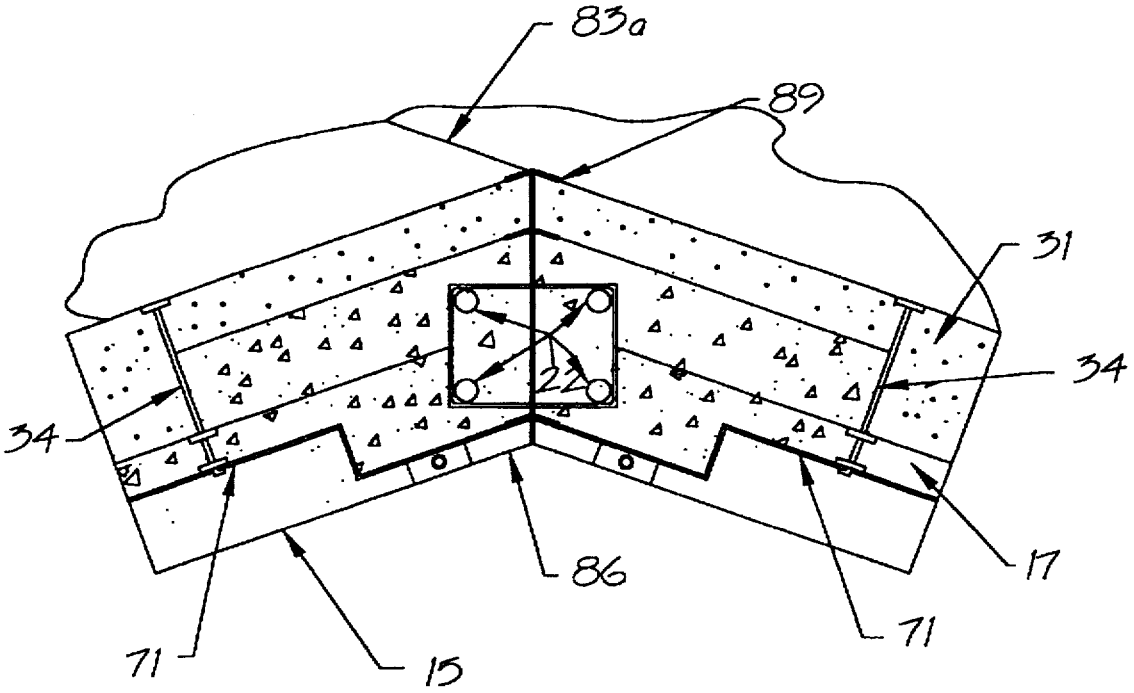
Figure 10:
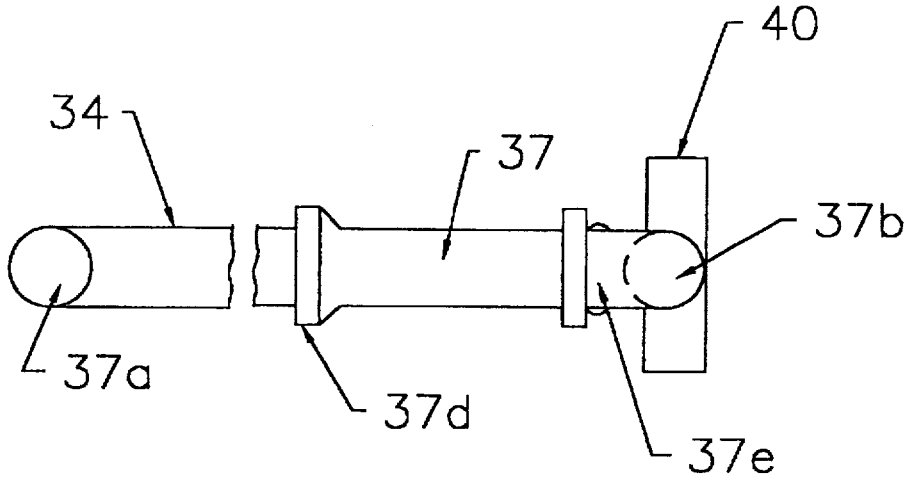
Figure 11:
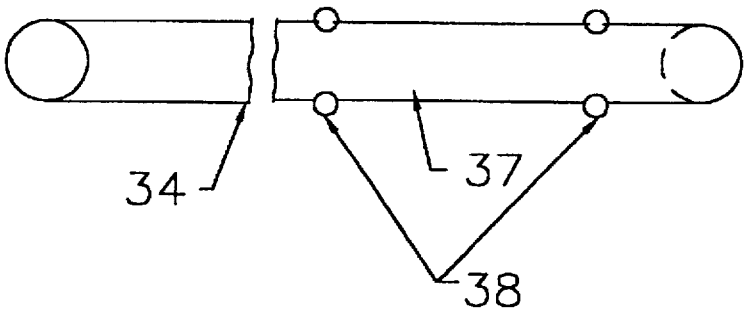
Figure 12:
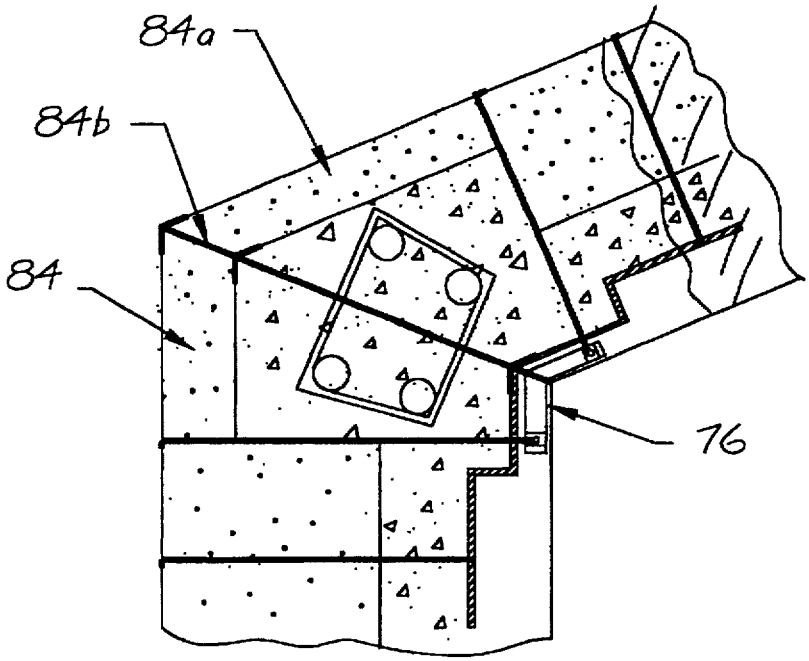

FIG. **7*a* is a fragmentary view of a window structure shown in FIG. 1**;

FIG. 8 is an enlarged vertical section taken generally on line 8—8 of FIG. 1 illustrating the interconnection between the sidewall and the roof structure;

FIG. **8*a* is an enlarged view of a corner connector shown in FIG. 8**;

FIG. 9 is an enlarged view illustrating the typical roof ridge interconnection in the building structure;

FIG. 10 is a view of a tie unit shown in FIGS. 1–9;

FIG. 11 is a view similar to FIG. 10 illustrating an alternate embodiment of the tie unit; and FIG. 12 is a simplified view showing an alternate roof-to-wall connecting structure to that shown in FIGS. 1–9.

DESCRIPTION OF THE ILLUSTRATED EMBODIMENT

Figure 2:
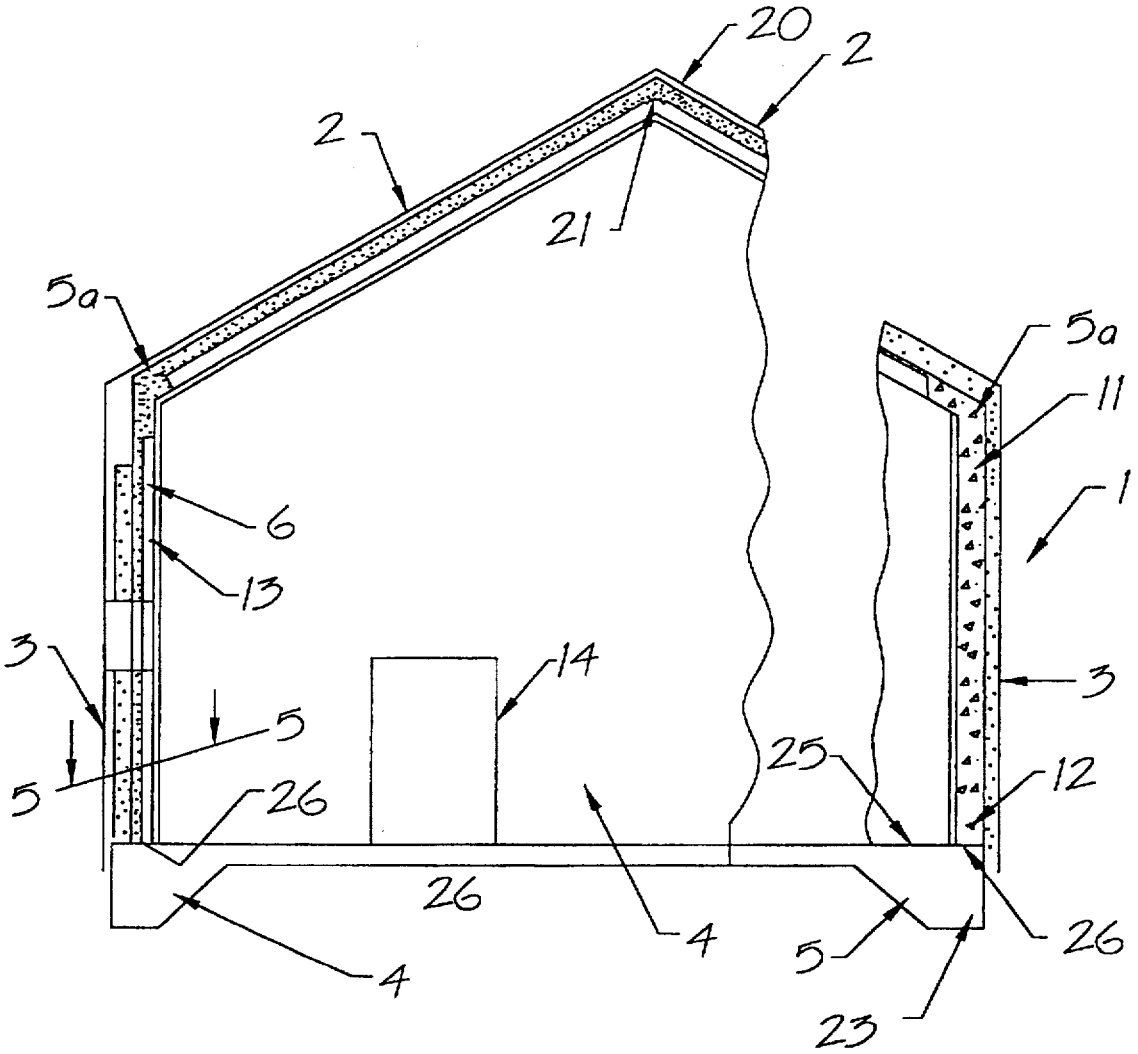
FIG. 2 is a sectional view of the building structure as shown in FIG. 1 and taken generally on line 2—2 of FIG. 1.

Referring to the drawings and particularly to FIGS. 1 and 2, a residential building 1 is illustrated having a gable roof 2 spanning opposite sidewalls 3 and mounted on a conventional concrete foundation 4. The gable roof 2 is secured to the sidewalls 3 by an integral interconnection 5, and the sidewalls and the roof structure are similarly constructed of unique poured concrete combination support for the preferred construction of the building. The building 1 is shown having an open span between the end sidewalls 3 over which the gable roof 2 is constructed in the illustrated embodiment of the invention, for simplicity and clarity of explanation.

Figure 3:
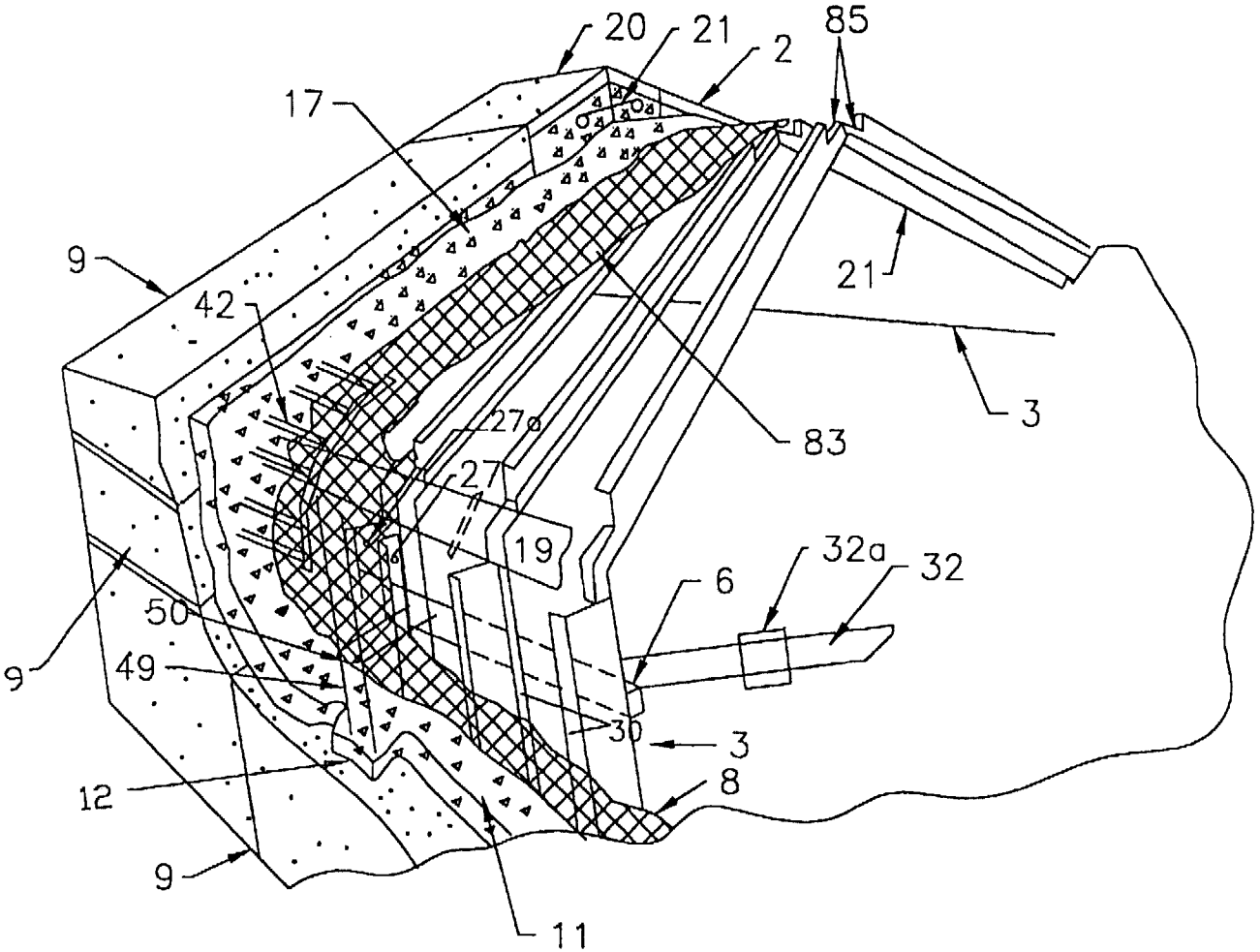
FIG. 3 is a pictorial and simplified view with parts broken away and sectioned to show inner detail of construction.
Figure 4:
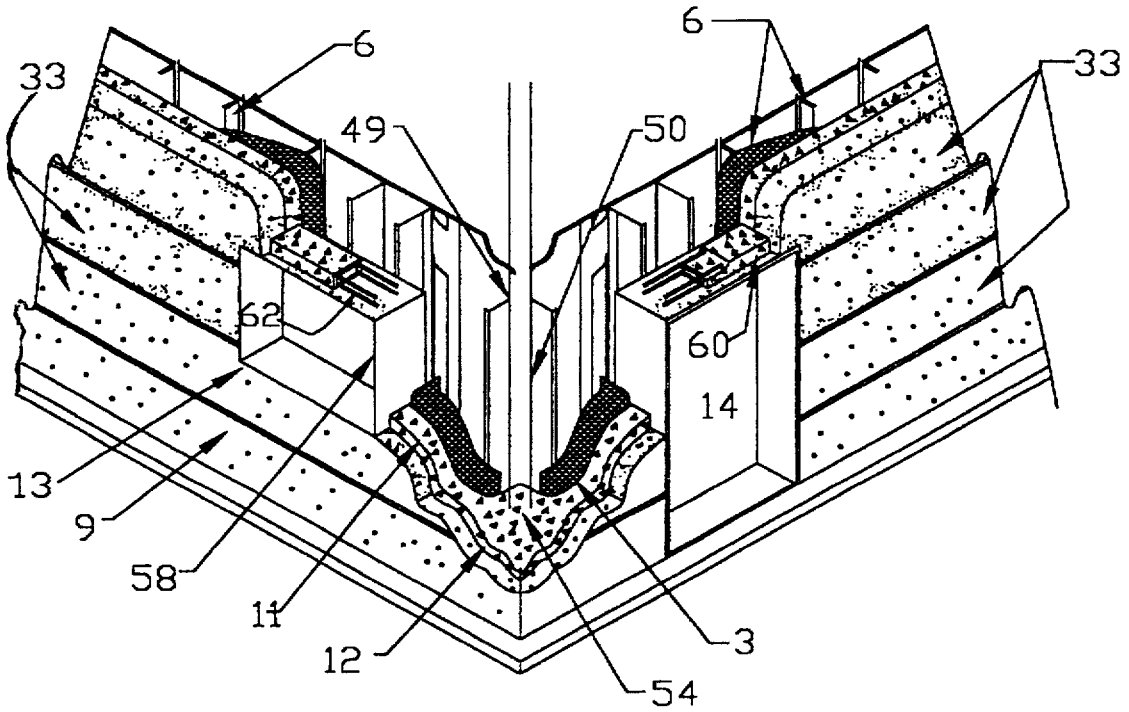
FIG. 4 is a view similar to FIG. 3 illustrating a corner structure of the building of FIGS. 1–3.

Referring particularly to the sidewall 3 shown to the front in FIG. 1 and the left side of FIGS. 2–5, vertical studs 6 are spaced in accordance with general construction dimensions on 16 inch centers or the like. Wallboard 7 is secured to the inner wall of the studs 6 and define an inner surface, which can be finished in any suitable manner in accordance with conventional construction. An open mesh 8, such as a conventional expanded metal or other suitable membrane material, covers the exterior side of the studs 6. A relatively thick insulating board or sheets forming an outwardly spaced insulating wall 9 is secured in spaced relation to the inner mesh 8 and studs 6 to define a wall spacement 10 therebetween (FIG. 5) which is filled with a concrete wall 11, as shown in FIGS. 2–4. As hereinafter described, wall 11 is cast in place after the formation of an inner wall structure with the mesh 8 and the outer wall 9, and other building supports secured in place. Reinforced concrete columns 12 are integrally formed in suitably spaced relation within the concrete wall 11 and at each corner. The inner drywall 7 and the insulating wall 9 form continuous inner and outer wall surfaces which can be finished, as desired. Window openings 13 and door openings 14 are integrally formed within the structure during the formation of the inner/outer wall supports and the in-place casting of the concrete wall 11. Generally, roof structure 2 is similarly formed with interior studs 15 and exterior insulating panels or sheets 16 with a poured concrete wall 17 therebetween. The roof structure 2 and particularly the concrete 17 is joined to the sidewalls by a special in-place interconnecting joints or junctions 18 with embedded rebars 19, with the concrete preferably poured to produce a monolithic concrete envelope or shell about the building, as hereinafter described. Similarly, the peak 20 of the roof 2 is formed with a special interconnecting joint or junction 21 with suitable rebars 22 to maintain a continuous roof structure including an outer insulating board wall, internal studs and an in-place concrete shell or wall. The illustrated embodiment of the structure includes a complete outer shell of high insulation material in combination with a wall and roof structure formed of a suitable concrete mix presently available for pumped concrete placement, provided with a suitable reinforcing member as required and as more fully developed hereinafter. A long life residential structure uses essentially all high strength materials and results in a sturdy structure which is adapted for use in widely varying environments which include different and severe environmental conditions. The construction may use readily available materials and technologies is particularly adapted to a modular prefab-form construction which can be formed in a factory, transported to the site and then assembled, with the concrete cast in place on site.

More particularly, in the illustrated embodiment of the invention, the building structure 1 is supported on a conventional concrete base foundation 4, shown in FIGS. 1 and 2, with a footing 23 within the ground 24. The footing has a flat surface 25. A plurality of upwardly opening base channel members 26 are shown secured to the top side of the foundation by suitable bolt units or the like, and project and open upwardly from the concrete foundation. The studs 6, in turn, are conveniently metal U-shaped channel members of a width to conveniently fit within the base channel members 26 and project upwardly therefrom throughout the height of the sidewalls into the roof connecting joints. The studs 6 are secured on appropriate centers, and further spaced at proper locations to accommodate window and door openings. Generally, U-shaped metal studs 6 of this variety are widely used in large high rise buildings for forming internal wall structures and are readily commercially available. Studs 6 are available, or may be readily formed, with internal vertically spaced openings 27 with horizontal connecting conduit 27*a*, preferably formed of a suitable plastic, between studs 6 for receiving of electrical lines, plumbing lines 28 and the like.

The wall and roof of studs 6 and 15 at the roof junctions or joint are interconnected to each other. The wall studs 6 are held in true vertical orientation using temporary supports, not shown, to maintain true vertical orientation of the inner wall structure, during the forming of the outer wall structure.

During the construction, including the pouring of the concrete, a temporary "whaler" board assembly 32 is preferably attached to the interior wall with adjustable screw jack support 32*a* to provide for the vertical orientation of the vertical wall structure. At the higher levels, if necessary, the "whaler" board unit, with suitable break-away tie elements, may support the plastic insulating boards or sheets in place. Similarly, roof studs 15 are held in coplanar relation by suitable temporary supports to produce a planar roof or ceiling wall in the finished building.

The expanded metal mesh 8, such as the well-known diamond-shaped expanded metal, is secured to the exterior flange of the studs 6 to form a continuous metal lath wall. The expanded metal mesh 8 may be conveniently applied by suitable attachment rivets or screw units 30 to the exterior face or flange of the studs 5 in accordance with known or other suitable attachment devices. Conventionally, a metal screw 30 is placed through a washer 31 and threaded directly into an appropriate opening in a stud 6. The expanded metal mesh 8 thus forms a continuous extended enclosure and provides an inner wall structure for confining of the poured concrete wall and establishing a firm interconnection to the concrete.

A suitable sheet-like membrane is preferably laid onto the expanded mesh within the root structure to contain any liquified material of the wet concrete during its placement. The membrane is preferably placed on the inner side of the mesh for subsequent removal if desired or required. The membrane may also be applied to a wall mesh. Thus, the membrane may add sufficient strength to allow use of a less costly mesh.

The width of the foundation exceeds that of the studs 6 and provides a continuous support surface surrounding the sidewall studs 6 and extends outwardly to provide a support for the outer concrete 11 and the insulating wall 33. The insulating wall is shown formed from stacked sheets 33 of a suitable and preformed insulating material. An expanded polystyrene plastic material is preferred because of its insulating factor, weight and the like. The expanded polystyrene material is generally known under the acronym, EPS, and is correspondingly identified in the present application. The well known product is available from Dow Chemical Company under the trademark STYROFOAM. The material is available as an extruded polystyrene or an expanded polystyrene plastic. The expanded sheets can be had in various densities. Generally, a density of between 1 and 1.25 pounds per cubic foot is desirable. The higher density is somewhat more costly and thus the exact weight of the material to be used will be related to the climate conditions of the building structure. The expanded polystyrene sheets have a minimum thickness of about 6 inches in order to provide for recessing of the insulating board in the area of the columns while maintaining significant insulating characteristics and structural integrity.

Figure 5:
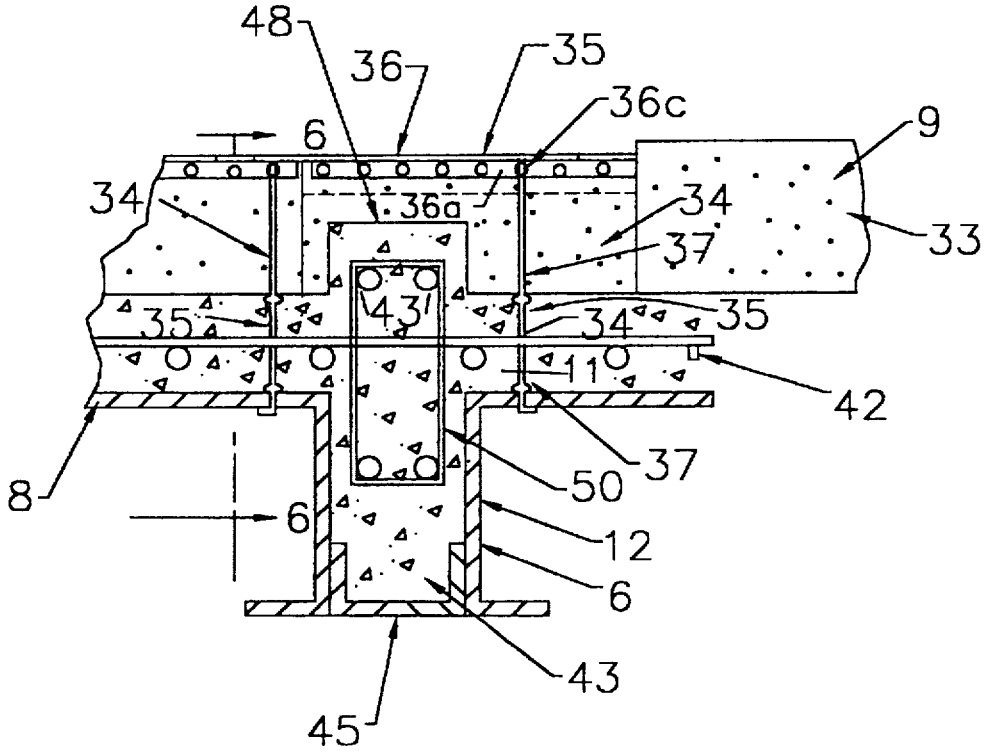
FIG. 5 is an enlarged horizontal section taken generally on line 5—5 of FIG. 2 and showing a typical sidewall column construction.
Figure 6:
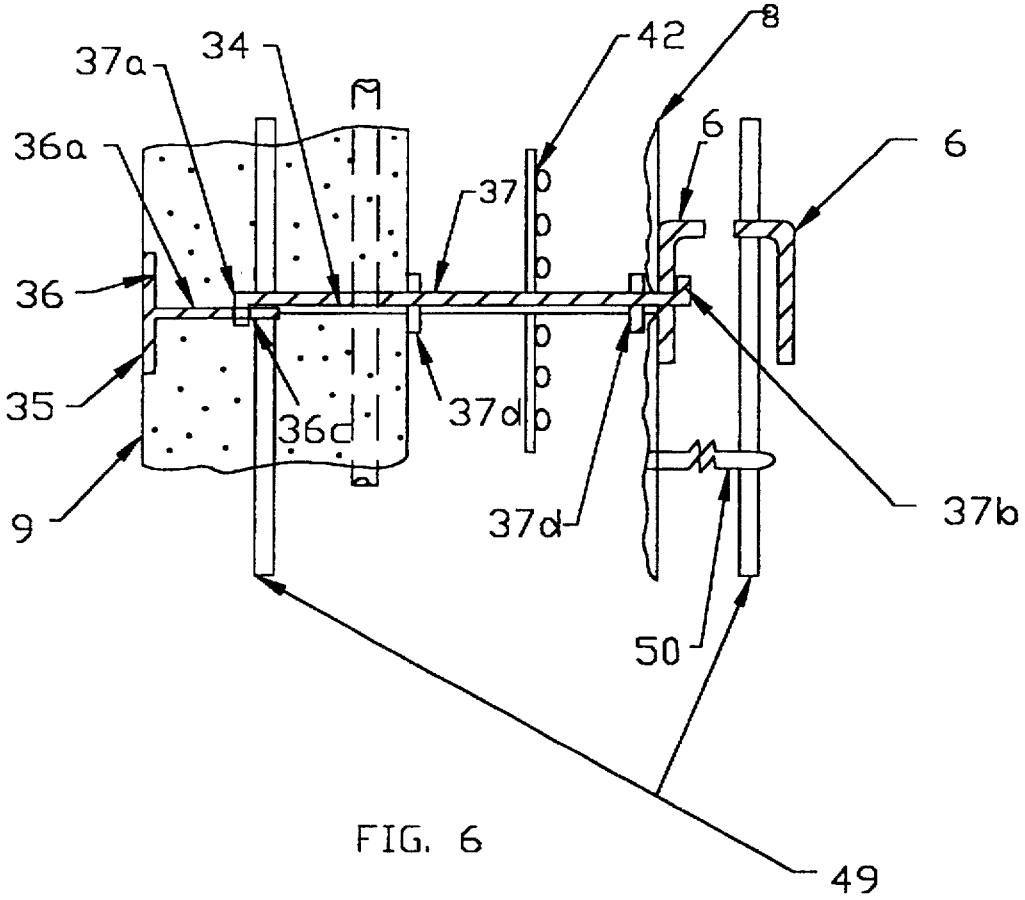
FIG. 6 is a vertical section taken generally on line 6—6 of FIG. 5.

Alternatively, the insulating shell can be formed at the columns by an outer extruded polystyrene board and a pair of overlapping and recessed expanded boards which are joined by a suitable adhesive or otherwise; for example, as shown in FIG. 1. In certain applications where a thicker reinforced concrete wall is poured, the insulation may be reduced and still provide an adequate column. In fact, the insulation and the concrete wall may have widely varying lines depending on the technical building requires. In a practical construction, 2×8 foot sheets were used. The bottom sheets 33 rest on the extended foundation in spaced relation to the expanded metal mesh 8 and define the vertical chamber 10 for receiving poured concrete 11. As shown in FIGS. 5 and 6, each sheet 33 is tied to the studs 6 by suitable tie units 34, tie units 34 are vertically spaced throughout the depth of the wall in alignment with each horizontal interface of successive courses of sheets 33 to firmly secure each sheet 33 in outwardly spaced and parallel relation to the metal mesh. The illustrated tie units 34 generally each include an elongated outer t-strap 35 abutting the exterior wall 9 at the same between the stacked sheets 33 and a tie bar or rod 37. The stem of the strap 35 is a horizontal plate 36*a* resting at a horizontal junction of insulation sheets 33 of the insulating wall 9 and the outer vertical plate 36 abutting the exterior wall surface of the two stacked insulation sheets 33. The horizontal plate 36*a* has spaced openings 36*c* throughout its length for alignment with the studs 6. The tie rod 37 has a bent end 37*a* which passes between sheets 33 or through a slot 38 in the sheet 33 and upon turning extends through an opening 36*c* in the stem 36*a* of the t-strap 35. The tie rod 37 further extends horizontally from wall 9 through chamber 10 and terminates in an outer bent end 37*b* similarly secured abutting the flange of the metal stud 6. The tie rod 37 has spaced abutment elements 37*d* and 37*e* welded, or otherwise formed, on the rod 37 to horizontally space the sheets 33 relative to expanded metal 8 to define a continuous spacement 10. In forming of the tie rods 37, the metal is readily formed from a rod-like member. The enlargements are shown in FIG. 5 formed as by positioning of a weld or button member onto the rod. Washers are slipped onto the rod and the ends of the rod bent into the desired configuration to provide the locating and securement abutment for locating of the members in appropriately spaced relation and thereby to define the gap or spacement for receiving of the wet concrete. In FIGS. 5 and 10, a tie rod 37 is shown with washers as elements 37*d* and 37*e*. In FIG. 11, a tie rod 37 is shown having struck out integral portions 38 as elements 37*d* and 37*e*.

Although the tie units 34 are described as formed of metal, another suitable material may be used, such as molded plastic members or elements. Further, although shown with the combination of the outer T-shaped members and separate tie bars, another suitable supporting structure between the outer insulating wall and the inner wall structure may be used to define the concrete wall space.

The insulation sheets 33 are held by the tie units 34 in vertical orientation and in a substantially true vertical plane, with the plumbing of the studs 6. In one construction system, a bottom row or layer of one or more insulation sheets 33 is secured to the studs 6 to define a concrete wall space 10 therebetween. Wet concrete 11 is introduced into the wall space such that the wet concrete drops an acceptable distance into the opening between the insulation and the inner panel structure. Wet concrete is here defined as a plastic or hydraulic concrete generally used in pumping of concrete and placement of pumped concrete. An acceptable drop distance is that distance in which the concrete can drop without significant and unacceptable segregation of the solid materials within the plastic or hydraulic concrete. Thus, it is important that the concrete maintain a continuous mixture with the elimination of voids within the concrete wall structure. Such technology is presently well known as a result of concrete placement and will be readily understood by those skilled in the art. Successive similar layers of sheets 33 and concrete 11 are formed to produce a vertical wall 3. Wet concrete 11 is thus sequentially placed to substantially fill the space 10 and partially moves through the expanded metal mesh 8 in accordance with conventional construction to form a firm interengagement to the metal mesh 8 and through the tie rod units 34 to the insulating wall 9. The expanded metal mesh 8 on the studs 6 and the insulating sheets thus define a form structure which is integrated into the building structure.

The interconnecting tie units 34 are connected to each of the vertical metal studs 6. Conventionally, such studs are made of a relatively light gauge metal, such as a 20 gauge metal. A simple J-bolt end may tend to create a bulge in the stud structure. As illustrated in FIG. 10, a spacer 40 may be connected to the stud end of the tie bars 34 abutting the stud flange and distribute the force over the stud flanges and thereby essentially eliminate any probability of deforming the stud. The spacer attached to the stud structure is also preferably shaped to fit the edge wall of the stud 6, which may have a rectangular configuration as shown. Alternatively, stud flanges may have a curved or wing-like configuration, as shown in FIG. 11. The use of a distributing member may be significant as any deformation within the form structure may show up as a defect in the inner wall structure. In addition, the spacers on the ties 34 also provide an improved and stronger connection.

In addition, a wire reinforcing unit 42 in the form of an open mesh of intersecting wires is secured within the concrete chamber 10. The mesh unit 42 is secured spaced from the metal mesh 8 and the insulation sheet 33 and thereby embedded in the concrete 11.

Throughout the length and at each corner of each sidewall 3 and 4, spaced column structures 12 are formed in suitable spaced relation to provide the necessary structural support on the sidewalls for supporting the ceiling and roof structure. Generally, column structures are formed in four foot centers and each corner. Each column structure 12 is preferably formed generally as shown, for example, in FIGS. 3–5. In the column structure 12 located within the sidewalls, studs 6 are located in horizontally spaced relation in accordance with the desired width of the finished column 43. The standard rectangular studs used throughout the inner wall is also used at each column, as shown in FIG. 5. The studs 6 are connected to each other by a suitable inner face plate 45 which spans the front space of the two column studs 6. The thin metal coupling plate 45 is connected to the adjacent column studs 6. The plate 45 is preferably formed as a U-shaped channel with ends 46 adapted to fit firmly within the inner bases of the adjacent studs 6, and project across to close the space between the adjacent stud 6.

The insulation sheet of the outer insulation wall 9 in alignment with the column studding 6 is recessed, as at 48, to form a generally similar configuration or extension of the concrete spacing 10 at each column 43 and thereby define a column support extending to the opposite sides of the enclosing concrete wall 11. The insulation recess may also be formed with overlapping and recessed insulation sheets, preferably with an extruded polystyrene member because of the greater strength, such as shown in FIG. 5.

Suitable vertical rebars 49 are embedded within the concrete foundation and columns 43 and preferably extend outwardly from the upper end of the concrete wall 11 for connection or as a single integral bar into the roof structure, as hereinafter described. The rebars 49 strengthen the column structure 12 and further contributes to the overall strength of the wall and roof structure.

The rebars 49 are interconnected to each other by suitable stirrups 50, each shown as a continuous bar which is bent about the rebars 49 to interconnect the rebars. The interconnecting stirrups 50 are shown as a single member with the ends overlapping and are generally provided as required for proper spacing of the rebars. The rebars 49 are typically number 5 bars or the structural equivalent. The stirrup 50 is typically a number 2 or 3 bar.

Figure 7:
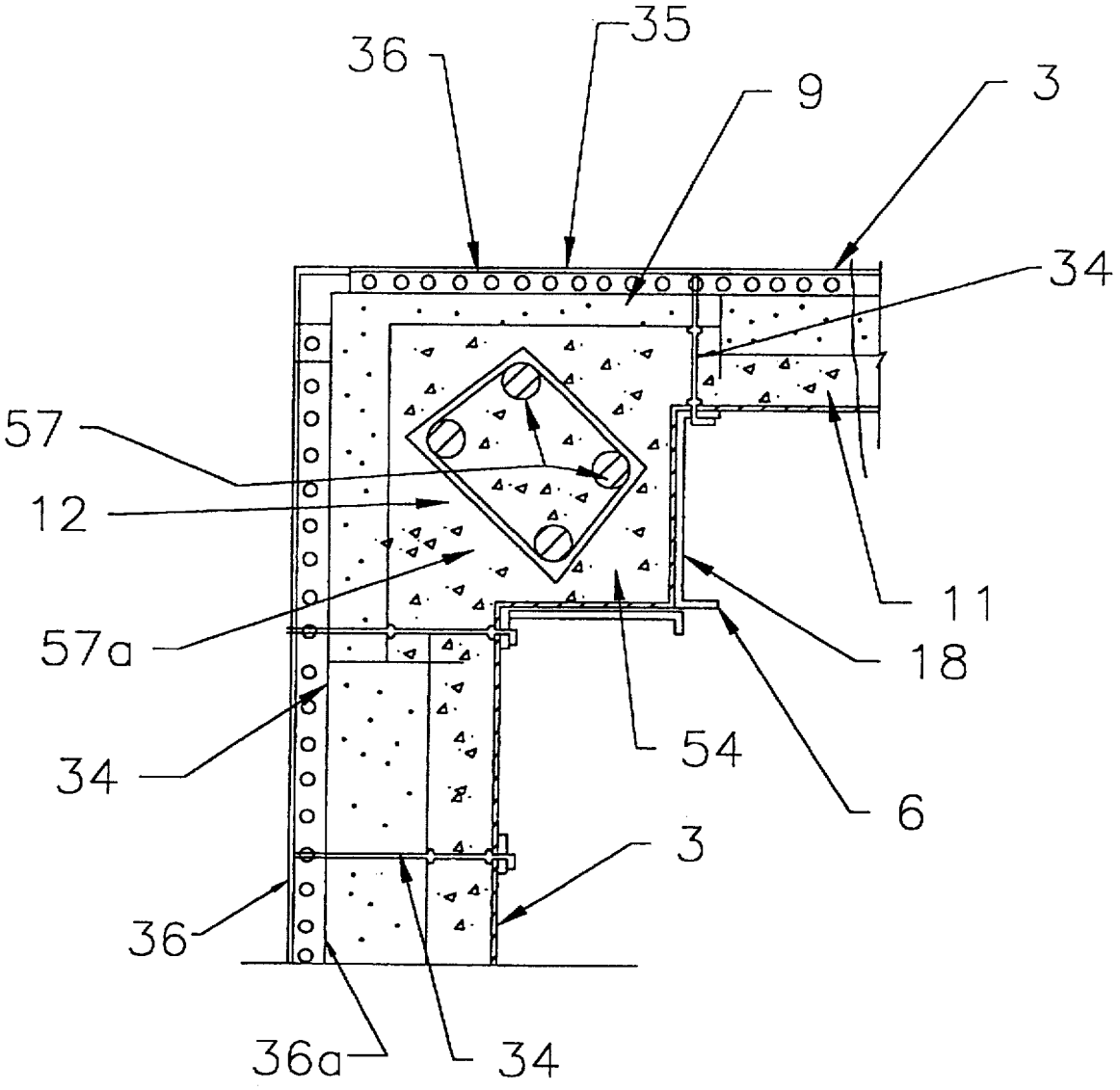
FIG. 7 is an enlarged horizontal sectional view illustrating a typical corner construction of the building structure.

A column structure 12 is also provided at each corner of the structure, as shown most clearly in FIGS. 3 and 7, to form a corner column 54. A pair of studs 6 are mounted in perpendicular abutting relation at the corner, and spaced to form a column 54 having a square cross-section, and with the outer stud sidewalls aligned with the exterior wall board planes. Tie bar units 34 are secured at the corner to the pair of studs to secure the abutting insulating boards in place. A plurality of four rebars 57 are also secured within each corner column and are connected to each other by encircling stirrups 57*a*.

Figure 7A:
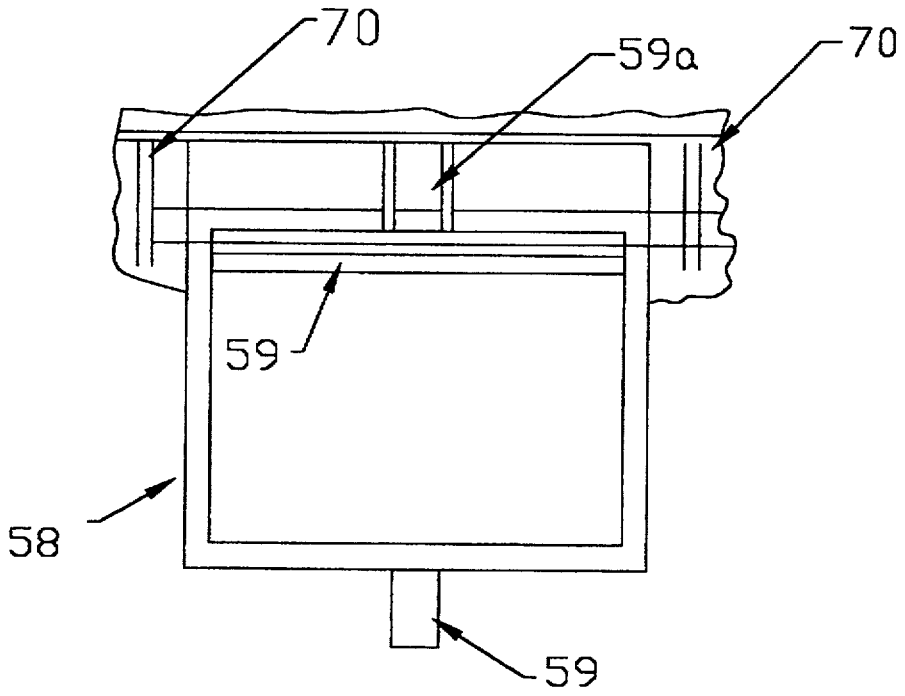

As also previously noted, the window and door openings are integrally cast into the sidewall structure. As shown in FIGS. 1, 4 and 7*a*. Reference is made to the window. A window opening buck or frame 58 is cast in place by appropriate location in overlying resting relation within the insulating wall 9 and projecting inwardly into the interior of wall studs 6. Channel plates 59 are secured to the top and bottom walls of frame 58 and studs 59*a* are appropriately cut to extend from the underside of the frame 58 to the base and from the upper wall of the frame 58 upwardly to the upper end of the sidewall structure 3 and into the necessary interconnection to the roof structure.

A concrete beam 60 (FIG. 4) is integrally cast into the concrete wall structure 11 above the window, and door units, by forming of an appropriate recess 61 within the insulating board or sheet 33 and casting the beam during pouring of the concrete wall. Referring to the window unit as shown in FIG. 4, each beam 60 includes a plurality of horizontal rebars 63 interconnected to each other by suitable stirrups 62. The concrete wall is cast to enclose the rebars 63 and thereby directly form a lintel extending over the top of the window form and with the rebars 63 projecting through the concrete. When the concrete 11 is poured into the openings, it fills the recess 61 about the rebars 63 to form beam 60 and spanning the opening and rigidly and firmly interconnected as an integral extension of the concrete supporting walls 11 to provide a reinforced concrete support spanning the opening and thereby reliably supporting the wall and roof structure above the window. The bottom lintel is similarly directly formed. If the window, door or other wall opening is not adjacent a standard wall column, m an added concrete column 70 is formed to the opposite sides of the window, door or like openings, and with the lintels integral therewith.

In the construction, the outer frame or buck 58 of the window, door, or the like is located within the frame work. The buck can obviously be formed of wood, channel irons, such as used in the studs or any other suitable material.

The door opening 14 is similarly formed with a frame, an upper beam and studs, as shown in FIG. 4.

The sidewall structure projects upwardly to the roof line. As previously broadly discussed, the roof structure is preferably formed in a manner essentially identical to that of the sidewall structures with a special interconnection to the sidewall structures.

With the illustrated roof, the end sidewalls, as shown in FIGS. 1 and 2, are specially formed to project upwardly into the roof line with the roof structure 2 resting thereon, as more fully presently developed.

Thus, referring particularly to FIGS. 3, 4, 8 and 9, the upper end of each sidewall stud 6 and aligned roof stud 15 is specially configured to form a high strength interconnection therebetween. The roof structure is supported prior to application of the concrete roof by vertical support members 71*a*, the upper end of which are provided with appropriate insert or whaler member defining the inclination of the roof structure. The support members are shown as rigid vertical posts, with an extension unit, and a generally U-shaped top channel. Elongated 2×4's, or like members 71*b*, having an appropriate angled top wall are located within the channel member and support the roof studs in appropriate location to define a smooth inner roof wall. The vertical posts are adjusted to establish a smooth inner wall structure upon application of the drywall or other interior wall covering.

Figure 8A:
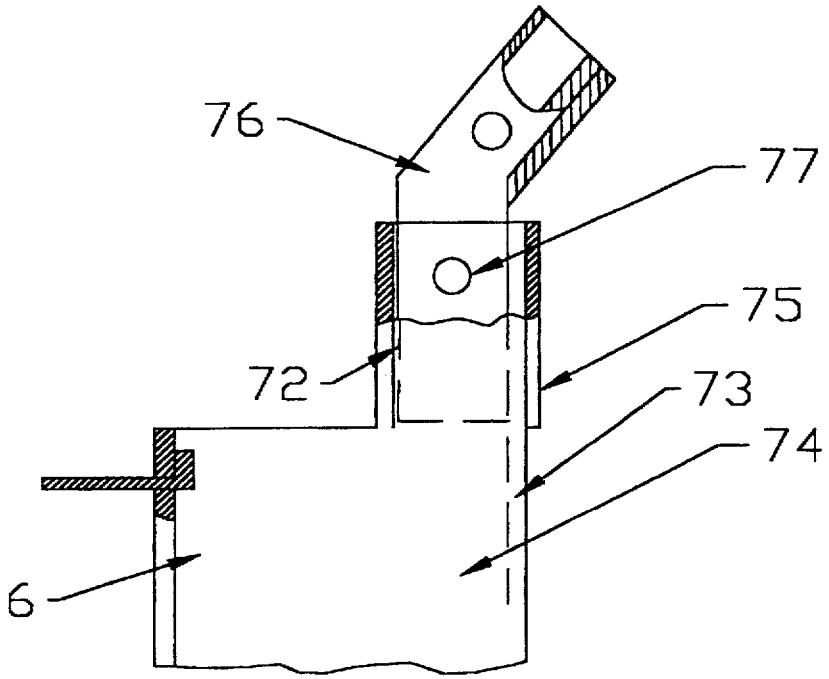

As most clearly shown in FIGS. 8 and 8*a*, each sidewall stud 6, as shown, includes an integral upstanding rectangular projection or coupling channel 72 projecting upwardly from an interior wall flange 73 immediately adjacent to the stud base 74. The channel 72 may be formed by cutting the base and one outer flange of the stud 6 to provide the metal which is wrapped about itself as at 75 to form the coupling channel projecting from the sidewall and forming a connecting end member.

Alternately, channel 72 may be provided as a separate square channel member which is extended into the upper end of the wall stud, of a proper length, and connected by screws, rivets, welds, or otherwise. The channel 72 is shown square but may be of any suitable shape. The roof studs 15 are similarly shown as U-shaped channel members also having a coupling channel 75. The side and roof studs thus terminate in alignment with the ends of the square coupling channels 72 and 75 in alignment. An appropriately angled connector 76, preferably a generally V-shaped tubular member, is telescoped onto the respective aligned coupling channels 72 and 75 and provide a physical interconnection therebetween. The tubular connector 76 is pinned or otherwise screwed to each of the studs 6 and 15 as by suitable screws 77.

The roof connection requires extension of the insulation wall 9 as a continuous outer shell and is preferably formed as most clearly shown in FIG. 8. The uppermost sidewall sheet 33 terminates essentially at the angled joint in the coupling connector 76. An angled corner sheet or block 78 is formed with vertical portion 78*a* abutting the upper end of sheet 33 and having an angled outer portion 78*b* extending upwardly parallel to and spaced outwardly by roof studs 15 to form a continuation of the concrete receiving chamber 10 within the roof structure. A standard tie bar unit 34 connects the roof corner sheet 78 to the vertical uppermost sheet and the inner wall stud 6, and a standard tie bar unit 34 similarly connects the upper end of the special cover sheet 78 to the upper sheet 33 and to the inner roof stud 15. The insulating corner block 78 connection system is located to the inner side of the sidewall and the lower side of the roof walls, and define a generally enlarged V-shaped chamber or spacement 10 between the sidewall insulating board 9 and the roof insulation board 16.

In assembly, the sidewall insulating sheet or wall 9 is projected upwardly to the plane through the angle of the connection between the two columns. The roof insulating sheets 15 are similarly secured in spaced relation to roof studs 71, in abutment with the sidewall insulating board or sheet 33 to form an essentially continuous outer side and roof wall of insulation enclosing the building structure.

The roof rebars 80 are formed as continuous extensions of the sidewall column rebars 49 and 57, as shown, and extend through the roof concrete space or chamber and are thus embedded in the poured joint concrete 81. In addition, roof rebars 80 extend through the roof structures 2 to the roof hip, and extend over and through the opposite side of the roof and opposite sidewall. Each sidewall and roof rib bar member may also be formed as a series of single integral members and bent at the corner junction and suitably interconnected to each other in a suitable manner.

The angled interconnection between the sidewall stud and the roof studs formed by the connecting connector 76 define an enlarged concrete chamber running the length of the building. The chamber provides an essentially continuous extension of the sidewall concrete chamber and thus a continuous concrete joint between the roof structure and the sidewall structures.

As shown in FIG. 8, the upper end of the sidewall includes an L-shaped plate 82 secured within the cutout portions of the studs 6 with a vertical leg abutting the tubular coupling channels 72 and a horizontal leg abutting the cut end of the studs 6. A similar L-shaped plate 83 is secured to the adjacent aligned ends of the roof studs 15. The wire mesh 8 is formed over and abuts the corner surface defined by the plates 82 and 83. The interconnecting angled coupling members, with the outer insulating member, define the concrete receiving corner chamber.

The system thereby provides a continuous reinforced concrete wall throughout the sidewall and the roof wall, with the appropriate interconnecting reinforcement in the significant areas or locations.

An alternate roof joint is shown in FIG. 12 wherein a flat sidewall sheet 84 and a flat roof sheet 84*a* is provided overlapping the top corner connection. The ends of the sheets 84 and 84*a* have abutting angled edges 84*b*. A special formed tie bar unit 84*c* passes through the abutting angled connection and is secured to an aligned stud connector 76. The special foam corner 78 of FIG. 8 is more readily formed and preferred.

At the peak of the roof 2, the metal roof studs 15 are interconnected to each other in a manner similar to the interconnection of the wall studs 6 and the roof studs 15. In particular, each of the roof studs 15 at the hip end is formed with a connecting tubular channel 85 adjacent the lower or inner flange. The adjacent channels 85 can again be integral to the studs or as separate members secured to the studs. The upper edges of the aligned channels are severed at an angle corresponding to the angle of the peak roof to locate them essentially in slightly spaced alignment. An appropriately angled connector 86 slips into the aligned ends and is secured therein, as by fixing screws or other suitable elements, to securely support the roof under structure. As most clearly shown in FIG. 9, the construction of the interconnecting joint provides an enlarged concrete spacement at the peak. Suitable rebars and stirrups 22 are located within the concrete at the roof hip.

The insulation roof sheets are connected on the flat walls of the roof to again form a continuous extension of the insulation as a continuous wall, with the tie bar units 34 occurring the same in spaced relation to form the roof concrete receiving chamber.

The roof insulating boards or sheets 33 are thus supported in spaced relation to the mesh in accordance with the desired thickness of the reinforced concrete roof structure. A special inverted V-shaped insulating block 87 overlies the hip portion of the roof and is mounted in place with the standard tie bar unit 34. Again, cut flat sheets could be used at the hip with a special tie bar unit, as previously discussed with respect to the corner connection at the top of the sidewalls.

Standard concrete placement practice dictates that concrete generally should not be dropped for an excessive distance; i.e., such as can result in concrete segregation.

The insulation sheets or board is readily formed as preformed panels maybe formed of any size which provide adequate support alone or with the tie structure.

A two foot vertical length provides a practical panel for assembly and support with tie bar units such as illustrated. The insulation board is light weight and can be manually set in place, as shown and described. All of these features contribute to the low cost and rapid on-site assembly with minimum of skill requirements dictated.

In construction of a small ranch home, the inventor found that the side walls could be formed and the wet concrete deposited through the column locations with the wet concrete of a consistency to permit the lateral flow to the sides of the columns. Thus, by moving from column to column, the concrete wall was formed throughout the structure. In the particular structure built, a first and second pass was made to completely fill the wall structure. However, the inventor's analysis indicates that it would be possible to deposit the wall in a single pass in such a building system. Similarly, after forming of the roof structure, similar depositing of the concrete through a very top ridge opening in alignment with column structures provides for simultaneous and double or single pass depositing of the wet concrete. Further, the total wall roof and form structure is preferably assembled and openings formed in the eve portion at the wall and roof juncture and in alignment with each column. Similar aligned openings would be provided at the roof ridge. Concrete would then be deposited through the wall openings either in a single or multiple pass and the total wall unit of reinforced concrete created. The openings in alignment with the columns would then be closed. Concrete would then be deposited through the ridge openings until the wet concrete was deposited within the roof structure. The openings in the roof ridge would then be closed to complete the structure. The above systems are particularly desirable where the appropriate wet concrete mix is available and provided, and requires a minimum number of personnel.

Alternatively, it is recognized that an excessive drop of wet concrete can, under certain circumstances, create a weak with undesirable secretion of the aggregate, and a progressive system of gradually building up the wall structures with a continuous depositing of the concrete about the structure can also be employed. Such a structure would involve the formation of various sublevels of the insulation structure beginning at the bottom of a depth desired for depositing in a given drop. As the pouring continued around the building, work personnel would build a second layer of the insulating wall such that upon completion of the first drop, the concrete would be continued to be poured into the second drop area. This of course could continue up through the wall structures and then onto to the roof structures in a similar manner. The advantage in the single or dual drop is also a more monolithic concrete wall structure. Thus, a wall structure is also less likely to have cold joints resulting from the interface between the successive drops of the concrete.

In either system, depositing of the wet concrete preferably through the use of a concrete pumping system which permits the ready movement about the periphery of the building with a continuous depositing of the wet concrete in a progressive and continuous manner to build the re-inforced concrete wall as a part of the inner wall structure and the in-place outer insulating wall.

The 2×8 foot panels are particularly practical where a limited drop is to be used as a two foot drop is clearly acceptable. Further, the panels are readily mounted in place and permit deposit of the wet concrete in a progressive manner starting at a given starting point on the periphery of the building structure, generally a corner of the wall structure. In the limited drop system, as the first course of the concrete wall is deposited, the second course of the insulating member is simultaneously being erected so that the depositing continues into the second course immediately upon completing of the first course, or even prior thereto by providing additional depositing machines or systems. In this manner, the wall building process continues around the building structure to complete the formation of the sidewalls. Immediately thereupon, the roof structure is similarly created by moving in sequence about the building with the concrete continuously deposited by moving around the structure and depositing of the wet concrete within the concrete chamber defined by the inner roof wall structure and the outer roof insulating sheets.

Although the wall thickness may be made as required to establish the structural strength desired, applicant has found that a 2½ inch concrete wall thickness is generally more than adequate for conventional building structures of one or two stories.

In the illustrated embodiment of the invention, the building structure uses a standard building concrete within the inner and outer wall form structure. The inside location of the concrete mass minimizes any significant temperature variation that would tend to expand or contract the concrete and thereby eliminates a serious source of structural cracks within the supporting concrete wall. It is well known that any cracks within the structure tends to weaken the concrete structure. The outer wall of insulation also protects the concrete during the curing process and thus provides a significant improvement in the characteristic of the concrete as a result of such improved curing. The outer insulating wall may be formed to provide a very significant "R" rating. Thus, for example, in an exterior "Styrofoam" board, each inch of thickness provides a number four "R" rating. In a practical construction, a six inch thick EPS board has been used and provides an "R" rating of 24. In addition, use of a completely enclosed concrete support mass in the walls and roof area, produces a very significant thermal mass. Thus, the concrete wall in the present system is particularly effective as the concrete wall defines the thermal sink operative in both the cold and hot weather. Thus, if the air conditioning is turned on, the concrete is separated from the inner air conditioned environment only by the wall stud structure. The concrete will then tend to increase and decrease in temperature in accordance with the internal cooling, and upon cooling act as cooling reserves. The insulating sheet wall will significantly contribute to retention of the reduced temperature state in the concrete wall. If for any reason, the forced cooling system is lost or it becomes necessary to eliminate the internal forced cooling, the cooling reservoir of the concrete wall applied cooling and the total building structure will heat up at a much lower rate, not only because of the EPS material, but because of the cooling provided by the surrounding concrete structure. For example, under certain conditions, the electric utility may have such an overload that certain areas must be cut off.

Alternatively, the utility may provide certain incentives to provide for cooling during certain hours while disconnecting of the cooling apparatus during other others. The same factors apply and result during heating season. Thus, again, the concrete will be subject to the internal heated environment and retain the heat due to the insulating wall. If it is necessary to remove the heat source, either intentionally or accidentally, the heat in the insulated concrete wall will dissipate heat into the rooms maintaining the temperature therein. Thus, the external integrated insulating mass in combination with the heat retention mass of the concrete provides a particularly practical and useful aspect in the maintaining of the environment. In an average size home, approximately 80 to 100 tons of reinforced concrete would be present serving as a heat sink. Thus, in the winter periods, the walls wall be heated during the day period and create a significant residue of heat for maintaining the comfort of the building at an essentially uniform temperature. Similarly, during periods of summer when the house is cooled using air conditioners and the like, the concrete again will again act like a "heat sink" to maintain the room temperature.

The structural concrete wall further provides a ready means of conforming to any required fire rating established by building codes throughout the United States. Thus, merely changing the thickness of the concrete in the walls and the roof will allow direct conforming to any specified fire rating.

Further, the outer insulating wall is completely isolated from the interior of the house by the concrete. The only connection which exists are the metal ties, which maintains there integrity and the separation of the interior from the insulation in the event of fire or other extreme heat conditions, and the window and door openings. If the ties are metal, a certain amount of thermal loss may occur. If desired, non-metallic members with a low thermal conductivity may be used.

Although plastic insulation members have been used within wall systems, the interior of the wall requires sheet rock or drywall coverings in order to protect the insulation from the heat, and particularly to conform to fire rating on the inside of the building. In such areas, the building codes may require furring strips for the attachment of drywall materials to the interior of the wall. All such limitations are essentially eliminated with the present constructions in which the insulating sheets are an integrated but only outer exterior part of the wall structure, and the exteriorly located insulation material is essentially separated from the interior of the structure by the structural concrete core. In addition, the support bar that is permanently anchored within the insulation board through the ties passing through concrete core should satisfy building code requirements and the outer end could also provide for special attachment to the wall which may be required for special exterior finishes, such as siding, stucco, brick or other desired outer wall members. Further, the exterior can be readily applied immediately after pouring of the concrete. Again, even if ties are formed of metal, the thermal transfer to the insulating sheets would not be such as to ignite the wall but rather melt the plastic about the coupling. Again if necessary, low thermal conductive material could be used.

Further, using the present construction and method, both the inner and outer wall forms are an integrated part of the final building component. The structure may therefore be readily adapted to factory prefabrication. Thus, the inner form structure is readily built using metal wall studs, expanded metal mesh and membrane, and standard fasteners for coupling to general panel structures which can then be erected on site. The panels, of course, would be designed and constructed in the factory in accordance with the housing specifications with the appropriate height and wall thickness of windows, doors and structural column dimensions built into the panel. The panels are readily connected to each other through the appropriate fasteners such as disclosed in the illustrated embodiment of the invention. The inner metal studs automatically provide the necessary furring strips for mounting of the drywall on the interior of the walls and ceilings.

The illustrated embodiment shows the system peak roof, other forms of roofs such as a gable-type roofs can also be readily constructed in accordance with this invention. Further, various interconnecting roof structures as well as wall structures can also be formed using appropriate edge interconnections to seal the connections and preferably constructed to maintain a continuous concrete wall and insulating member construction consisting of the inner wall and the outer insulating members spaced to receive the concrete layer or wall.

The system is readily adapted to forming of structures with a clear span width of 30 feet or more. The span width will dictate the necessity of supports within the various column areas and within the roof structure. The clear span feature is desirable as eliminating the necessity for internal load bearing partition walls and providing maximum flexibility of design within the reinforced concrete wall structure.

Although shown in the particular roof construction, the structural column and roof top design can adapt the system to provide any type of internal structures including cathedral ceiling, lofts, a flat ceiling and with internal storage and closet space in any particular combination. Thus, the illustrated embodiment shows the system peak roof, other forms of roofs such as a gable-type roof can also be readily constructed in accordance with this invention. Further, various interconnecting roof structures as well as wall structures can also be formed using appropriate edge interconnections to seal the connections and preferably constructed to maintain a continuous concrete wall and insulating member construction consisting of the inner wall and the outer insulating members spaced to receive the concrete layer or wall. With the present invention using essentially factory paneling designed to form an integrated part of the structure, labor variations and on-site events are minimized. Further, rapid construction of the outer wall structures minimizes the effect of the influence of weather on the overall construction.

The exterior of the poured concrete building is readily finished on the exterior with any type of desired finish including stucco, sprayed on concrete and other assembly materials as well as conventional horizontal or vertical siding, brick and/or stone.

The utilities for the building structure, including the electrical heating and plumbing, are provided for in the design of the studs. Standard trim and cabinets, windows, doors and other known work items can all be standard off-the-shelf items installed in a conventional manner with no other skills than that required with present day construction.

Thus, the present invention is particularly directed to building a residential or other structure while minimizing on-site construction requirements and delays as well as providing a rapid cost-efficient construction. The system particularly eliminates variable factors encountered by climatic conditions while maintaining precision of construction. The building is essentially formed of concrete and steel similar to the structure used in commercial and institutional buildings and the like and thus can anticipate having the corresponding long life.

Although illustrated in a particular preferred construction, variations can, of course, be readily applied. Thus, although shown with an integrally formed concrete roof, the sidewalls can be formed in accordance with the present invention and a conventional roof structure attached.

Various modes of carrying out the invention are contemplated as being within the scope of the following claims particularly pointing out and distinctly claiming the subject matter which is regarded as the invention.

I claim:

1. The method of constructing a residential building including at least one exterior sidewall constructed in the following steps comprising, forming an inner wall frame consisting of a plurality of vertical spaced studs having an interior side and exterior side, securing an open mesh structure to the exterior side of said studs, securing an outer thermal insulating wall of plastic insulating panels to said studs in outwardly spaced relation to said open mesh structure, said outer thermal insulating wall creating a high thermal insulating "R" factor within said exterior sidewall, said mesh and said plastic insulating panels defining a concrete receiving spacement, and depositing wet concrete into said spacement to fill said spacement and said wet concrete flowing into said mesh and into firm abutting engagement with said outer thermal insulating wall to form a self-supporting concrete exterior sidewall, said plastic insulating panels of said insulating wall being of sufficient strength to support the wet concrete.

2. The method of claim 1, including the step of selecting said studs having a substantially U-shaped configuration with an interior flange and an exterior flange and a base joining said flanges, said base of said studs having spaced openings for accommodating plumbing and electrical lines.

3. The method of claim 2, including interconnecting rod-like tie members to said exterior flanges and to said panels prior to the depositing of said wet concrete to locate and secure said panels and to support said panels and wet concrete and whereby said tie members are embedded into said concrete exterior wall to form a part of the residential building.

4. The method of claim 1, wherein said residential building includes first and second exterior sidewalls located parallel to each other including the steps of interconnecting first roof studs to said first exterior sidewall and extending inwardly and upwardly to an outer end between said first and second exterior sidewalls, interconnecting second roof studs to said second exterior sidewall and said second roof studs extending inwardly and upwardly to said outer end of said first roof studs, and means connecting said first and second roof studs being interconnected to each other at said outer end to define a roof ridge, each of said first and second roof studs including an exterior side, applying an open mesh structure to the exterior side of said roof studs and formed as an essential continuation of the mesh structure on said first and second sidewalls, securing an outer thermal insulating roof wall of thermal insulating panels to said roof studs to form an extension of the thermal insulating panels and forming a concrete receiving roof spacement, and depositing wet concrete to said roof spacement to form a concrete roof with a roof ridge at said center, said thermal including roof panels being of sufficient strength to support the wet concrete.

5. The method of claim 4, including aligning said roof studs and said sidewall studs, interconnecting of said roof and sidewall studs, and securing reinforcing rebar rods at the interconnection of the roof and sidewall studs prior to depositing of the wet concrete in said roof spacement.

6. The method of claim 5, wherein the roof ridge has said first and second roof studs interconnected to securing and reinforcing rebar rods along the roof ridge and wherein the concrete thickness introduced throughout the roof ridge encloses said rods.

7. The method of claim 1, wherein said plastic insulating panels having an exterior wall and including covering the exterior wall of said insulating panels to form a finish on the exterior of said sidewall.

8. The method of claim 1 including introducing concrete reinforcing structure within said concrete receiving spacement prior to depositing of the wet concrete into said spacement with said reinforcing structure spaced from said open mesh and said plastic insulating panels, and thereafter including said depositing of said wet concrete.

9. A method of forming a building including an inner wall unit having a vertical supporting structure with an outer confining cover and an outer wall unit including a thermal plastic insulating wall secured in outwardly spaced relation to said inner wall unit and defining a concrete space therebetween forming an outer sidewall of the building, comprising pouring wet concrete into said concrete space to form a continuous concrete wall integrated with said inner wall unit and said insulating wall as a continuous integrated outer wall with said thermal plastic insulating wall as one exterior wall of said outer sidewall of said building, said thermal plastic insulating wall being of sufficient strength to support the wet concrete and provide a high insulating "R" factor.

10. In the method of claim 9, including circumferentially spaced column spaces formed in said concrete space and forming extensions therein, each said column space having an upper end, including the step of pouring said wet concrete in the upper end of each column space with said wet concrete moving downwardly and laterally from each column space to completely fill said concrete space.

11. The method of claim 10 including forming a raised roof structure and forming a junction to said sidewall and extending upwardly from said sidewall to an upper end, said roof structure having an extension of said inner wall unit and an extension of said thermal plastic insulating wall forming a roof concrete space extending upwardly to an upper roof end, and comprising the further steps of providing roof openings at said upper end in alignment with each column space at the junction of the roof structure and sidewall and first pouring said wet concrete through said upper end of each said column space to form said outer sidewall and thereafter pouring said wet concrete through said roof openings and forming said roof structure.

12. The method of claim 11 wherein said roof openings include a plurality of spaced openings, and including pouring said wet concrete in a progressive and continuous manner in the upper end of first column space and allowing the wet concrete to move downwardly and laterally throughout the concrete space adjacent said column space, and progressively moving about said concrete space to deposit wet concrete in said column space adjacent to an immediately previously filled column space, closing of the upper end of each said column space after filling of said space and said sidewall concrete space, and thereafter progressively depositing wet concrete into adjacent roof openings and allowing the concrete to move down and laterally throughout the roof structure, and finally closing of the roof openings to complete the building structure with an integral continuous shell consisting of the inner wall unit, said thermal insulating wall and the deposited concrete of the sidewall and roof is a single integral assembly.

13. The method of forming a building, comprising assembling a sidewall having an inner wall unit including vertical wall members each having an inner side, securing a cover to the inner side of said vertical wall members, securing a plastic thermal insulating wall in outwardly spaced relation to said inner wall unit and defining a concrete space therebetween, said concrete space having a top wall opening, assembling a roof to said sidewall, said roof extending upwardly to a top end, said roof including an inner roof wall unit and an outer roof thermal insulating wall connected to and forming an extension of said inner wall unit of said sidewall and said plastic thermal insulating wall connected to the inner unit of said sidewall to form a roof concrete space and to form a junction at the upper end of said sidewall between the sidewall and the roof and forming a substantially continuous shell on said building, forming spaced wall openings in said sidewall at the junction of the roof and sidewall and roof openings at the top end of said roof, depositing wet concrete through one of said top wall openings and allowing the wet concrete to move downwardly into the concrete space including lateral movement therefrom, progressively moving about said sidewall to deposit said wet concrete in each said wall openings and moving from one top wall opening to an immediately adjacent said top wall opening in a progressive manner about said sidewall, closing each said top wall opening, introducing wet concrete into one of the roof openings and then progressively depositing said wet concrete in successively adjacent roof openings and allowing the wet concrete to move down and laterally throughout the roof concrete space, and closing of the roof openings to complete the building.

14. A residential building structure having a plurality of interconnected encircling sidewall structures with opposed sidewalls interconnected to a roof structure, comprising:

an inner support wall formed of a toxic free construction, a thermal insulating exterior wall located in outwardly spaced relation to said inner support wall and defining a concrete receiving spacement there between, securement units securing said thermal insulating exterior wall to said inner wall and supporting said thermal insulating exterior wall, said thermal insulating exterior wall establishing a high R insulating factor, and concrete disposed within said spacement in a wet state and upon hardening forming a firm concrete interconnecting wall to said inner support wall and said thermal insulating exterior wall for sealing and forming an integrated vertical wall inclusive of said insulating exterior wall and said inner support wall and said securement units.

15. The structure of claim 14, wherein said inner support wall includes channel-shaped studs having an interior flange and an inwardly spaced flange and base connecting said flanges, a mesh member secured to said inwardly spaced flange and having openings to allow partial embeddment of said wet concrete to define an inner plane of the concrete interconnecting wall.

16. The building structure of claim 15, wherein said insulating wall includes a plurality of plastic sheet elements in abutting relation, and connecting elements connecting said sheet elements to said inner support wall.

17. The building structure of claim 16, wherein said securement units include rigid tie rods secured to said studs and extending outwardly to said thermal insulating exterior wall, and means securing said tie rods to said insulating exterior wall to support the insulating exterior wall.

18. A small building structure having a plurality of sidewalls with first and second opposed sidewall structures interconnected by a roof, comprising an inner support wall formed of a toxic free construction, a plurality of thermal insulating wall members located in abutting engagement and in outwardly spaced relation to said inner support wall and defining a concrete receiving spacement therebetween, securement units securing said insulating wall members to said inner support wall, and wet concrete disposed within said spacement in a wet state and upon hardening forming a firm concrete wall interconnected to said support wall and said thermal insulating wall and sealing and forming an integrated vertical wall inclusive of said thermal insulating wall and said inner support wall and said securement units, said thermal insulating wall members supporting said wet concrete.

19. The small building structure of claim 18, wherein said inner support wall includes a plurality of vertically spaced stud secured in spaced orientation throughout the sidewall, an apertured wall member secured to the exterior of said studs and defining an inner form wall, said thermal insulating wall including a multiple panel assembly secured to said studs in outwardly spaced relation to said apertured wall member and defining said spacement.

20. The small building structure of claim 19, wherein said studs are channel-shaped members having an interior flange and an inwardly spaced flange and base connecting said flanges, said apertured wall member being an expanded material member secured to said inwardly spaced flange.

21. The small building structure of claim 18, wherein said thermal insulating wall members include a plurality of rigid plastic panels, and connecting structure joining said panels to each other to form a continuous wall structure.

22. The small building structure of claim 18, wherein said roof includes an inner support wall formed of a toxic free construction, a thermal insulating wall located in outwardly spaced relation to said inner support wall and defining a concrete receiving spacement therebetween, mechanical securement units securing said insulating wall to said inner wall, reinforcing members secured within said spacement and concrete disposed within said securement in a wet state and upon hardening forming a firm concrete wall interconnected to said inner support wall of said roof and said thermal insulating wall of said roof and sealing and forming an integrated roof wall inclusive of said thermal insulating wall and said inner support wall and said securement units and reinforcing members to form a total concrete enclosure within the building structure with said thermally insulating wall providing a high R thermal rating.

23. The structure of claim 22, wherein said reinforcing members include a plurality of reinforcing rods, said inner support walls of said sidewalls and of said roof include aligned studs and an apertured wall member secured to said studs, and further including members rigidly interconnecting of said wall and roof studs.

24. The structure of claim 21, wherein said connecting structure includes spaced mechanical securement units, each said unit includes a t-shaped element including a plate-like cross member and a plate-like stem projecting from the cross-member, said t-shaped element located with the stem between the abutting panels and the cross member abutting adjacent panel members, and connecting members secured to the stem and to said inner support wall.

25. The structure of claim 24, wherein said inner support wall includes spaced wall studs, said abutting panels having inner surfaces, each said connecting members including an elongated rigid member, and said elongated rigid members are secured to said stem and to said studs, and having at least one locating member on each said elongated rigid member abutting said inner surface of at least one of said panels.

26. The structure of claim 24, wherein said plastic panels are an expanded polystyrene foam.

27. The structure of claim 21, wherein said plastic panels are an extruded polystyrene foam.

* * * * *